US006146087A

United States Patent [19]

Perry

[11] Patent Number: 6,146,087

[45] Date of Patent: Nov. 14, 2000

[54] DENESTING DEVICE AND METHOD FOR DENESTING A BLOCK OF PRECUT MATERIAL

[76] Inventor: Arthur H. Perry, W6530 Shoreland Rd., Elkhart Lake, Wis. 53020

[21] Appl. No.: 09/032,672

[22] Filed: Feb. 27, 1998

[51] Int. Cl.[7] ..... B65G 59/00

[52] U.S. Cl. ..... 414/798.9

[58] Field of Search ..... 414/796.2, 796.3, 414/798.9, 751.1; 198/458, 442, 375

[56] References Cited

U.S. PATENT DOCUMENTS

| | | | |
|---|---|---|---|
| 2,907,443 | 10/1959 | Rosso | 198/442 |
| 2,970,360 | 2/1961 | Cabell et al. | 414/798.9 |
| 3,601,266 | 8/1971 | Pearne | 414/796.3 |
| 3,602,358 | 8/1971 | Jakobsson | 414/798.9 |
| 3,602,963 | 9/1971 | Lingl | 414/791.3 |
| 3,939,993 | 2/1976 | Lingl, Jr. | 414/796.3 |
| 4,019,620 | 4/1977 | Frenkel et al. | 198/399 |
| 4,750,132 | 6/1988 | Pessina et al. | 414/751.1 |
| 5,133,444 | 7/1992 | Thomason | 198/375 |
| 5,281,082 | 1/1994 | Ghilardi | 414/798.9 |
| 5,399,063 | 3/1995 | Passero | 414/798.9 |
| 5,487,461 | 1/1996 | Focke et al. | 414/798.9 |
| 5,630,697 | 5/1997 | Black, Jr. | 414/798.6 |
| 5,746,572 | 5/1998 | Winski | 414/796.3 |

*Primary Examiner*—Douglas Hess
*Attorney, Agent, or Firm*—Jansson, Shupe, Bridge & Munger, Ltd.

[57] ABSTRACT

A denesting device and a method of denesting a block of precut material is provided. The denesting device includes a conveyor having first and second opposite ends and a belt structure traveling therebetween. A belt structure conveys the block of material from the first end of the conveyor over the second end of the conveyor. A denesting structure is positioned adjacent the second end of the conveyor. The denesting structure includes a rotatable shaft extending transverse to the belt structure wherein the rotatable shaft engages a portion of the block of material as the block of material is urged over the second end of the conveyor by the belt structure and denests the block of material into a predetermined number of subparts. The subparts fall onto a conveyor belt where they are transported to a weighing or packaging station.

33 Claims, 9 Drawing Sheets

FIG. 3
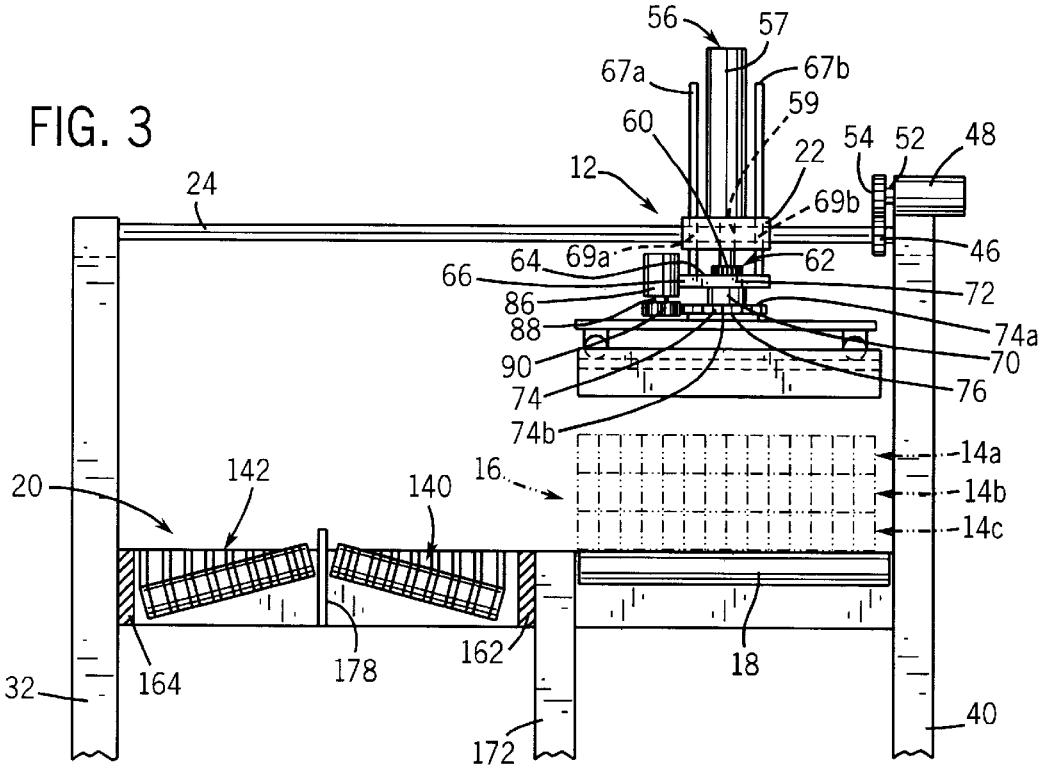
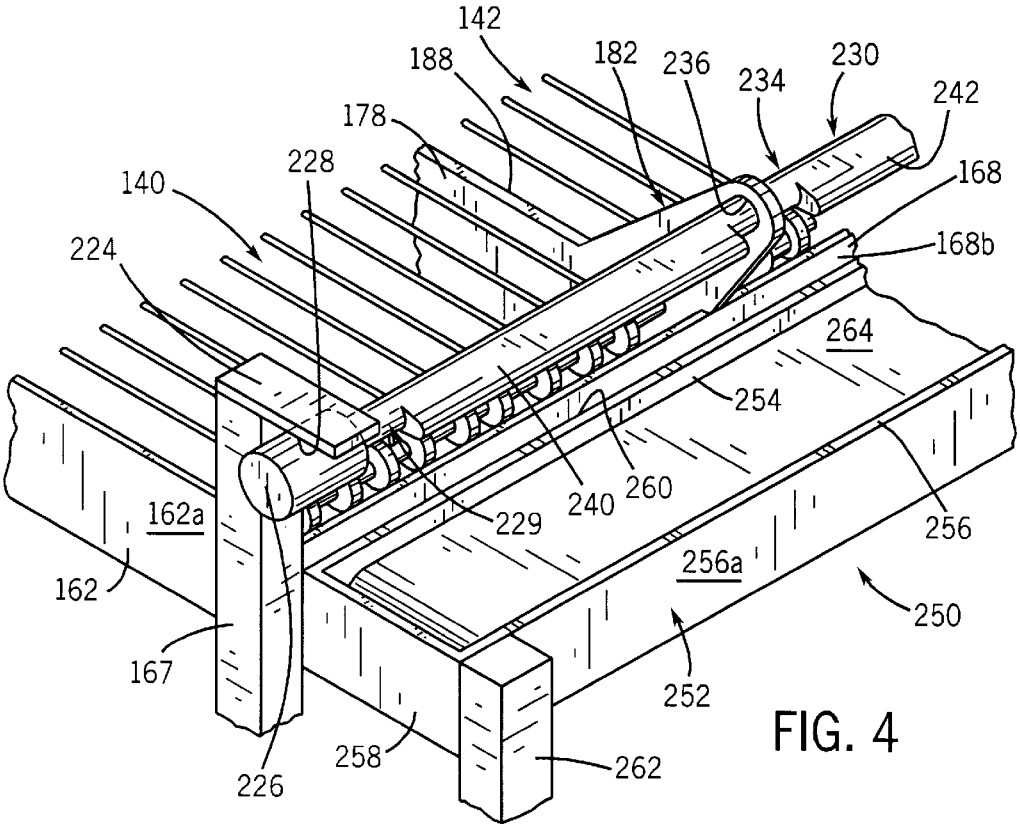
FIG. 4

DENESTING DEVICE AND METHOD FOR DENESTING A BLOCK OF PRECUT MATERIAL

BACKGROUND AND SUMMARY OF THE INVENTION

The present invention relates to a device for denesting a block of material, and in particular, to a device for denesting a precut block of cheese.

Typically, cheese is formed in bulk size blocks which are cut into smaller pieces by a wire harp cutter. Individuals manually separate each piece of cheese from the block, and place the pieces on a flighted belt of a conveyor. The flighted belt transports the pieces of cheese to a predetermined location such as a weighing station or a wrapping machine. The process of manually desnesting the pieces of cheese from the block is labor intensive, and hence expensive. As a result, it is highly desirable to provide a less expensive device and method for denesting a block of precut cheese.

Therefore, it is a primary object and feature of the present invention to provide a cheese denesting device which substantially reduces or eliminates the need for an individual to manually denest a precut block of cheese.

It is a further object and feature of the present invention to provide a cheese denesting device which is simple to operate and reduces the labor costs associated with denesting a precut block of cheese.

It is a still further object and feature of the present invention to provide a method for denesting a precut block of cheese which is simple and inexpensive.

In accordance with the present invention, a denesting device is provided. The denesting device includes a conveyor structure having first and second opposite ends. A transport structure is provided for transporting a precut block of material and placing the same onto the first end of the conveyor. A belt structure travelling on the conveyor structure conveys the block material from the first toward the second end of the conveyor structure. A denesting structure positioned adjacent the second end of the conveyor denests the block of material into a predetermined number of pieces.

The belt structure of the denesting device includes first and second belts travelling on the conveyor structure. A breaker bar is positioned between the first and second belts of the belt structure. The breaker bar separates the block of material into first and second block portions upon placement of the block of material on the first end of the conveyor.

The transport structure includes a gripping element for gripping the block of material. The gripping element is movable between a first open position and a second gripping position, and includes first and second parallel gripping arms interconnected by a retractable cylinder. Each of the gripping elements includes a vertical arm to prevent lateral movement of the material when the block of material is being transported by the transport structure, and a horizontal breaking arm for breaking the block of material into the block portions on the breaker bar.

The transport structure further includes a carriage supported above the conveyor structure by a lead screw and a support rod. The carriage is movable between a first pickup location and a second deposit location overlapping the second end of the conveyor. Rotation of the lead screw transports the carriage along the support rod between the pickup and deposit locations. A gripping positioning structure interconnects the carriage and the gripping element. The gripper positioning structure is movable between a first lowered position, a second depositing position, and a third breaking position.

The denesting device of the present invention further includes a subpart conveyor vertically spaced from the second end of the conveyor structure. A ramp structure has a first end interconnected to the conveyor structure and a second, opposite end which appears downwardly toward the subpart conveyor.

The denesting structure includes a rotatable shaft extending transverse to the belt structure. The rotatable shaft engages the block of material as the block of material extends over the second end of the conveyor structure. The rotatable shaft has a generally tear-dropped shaped cross section. A sensor senses when a portion of the block of material extends over the second end of the conveyor section and causes rotation of the rotatable shaft in response thereto.

In accordance with an additional aspect of the present invention, a denesting device is provided for denesting a block of precut material. The denesting device includes a conveyor having first and second opposite ends and a belt structure travelling therebetween. The belt structure conveys the block of material for the first end of the conveyor over the second end of the conveyor. A denesting structure is positioned adjacent the second end of the conveyor. The denesting structure includes a rotatable shaft extending transverse to the belt structure wherein the rotatable shaft engages a portion of the block of material urged over the second end of the conveyor by the belt structure and denests the block of material into a predetermined number of pieces.

In a still further aspect of the present invention, a method is provided for denesting a block of precut material. The method includes the steps of depositing the block of material on a conveyor and conveying the block of material toward a denesting structure. The block of material is denested into a predetermined number of subparts and the subparts are transported to be packaged.

The step of depositing the block of material on a conveyor may include the additional steps of providing a gripper element to grip the block of material and closing the gripper element about the outer periphery of the block. The block of material is then transported with the gripper element to a predetermined position above the conveyor. Thereafter, the block of material is released from the gripper element.

The step of denesting the block of material may also include the additional steps of providing a rotatable shaft and sensing the position of the block of material. In response to the position of the block of material, the rotatable shaft rotates and engages the block of material.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 3 is a rear end view of the denesting device of FIG. 1;

FIG. 4 is an enlarged, isometric view showing a portion of the denesting device of FIG. 1;

DETAILED DESCRIPTION OF THE INVENTION

Figures 1, 2:
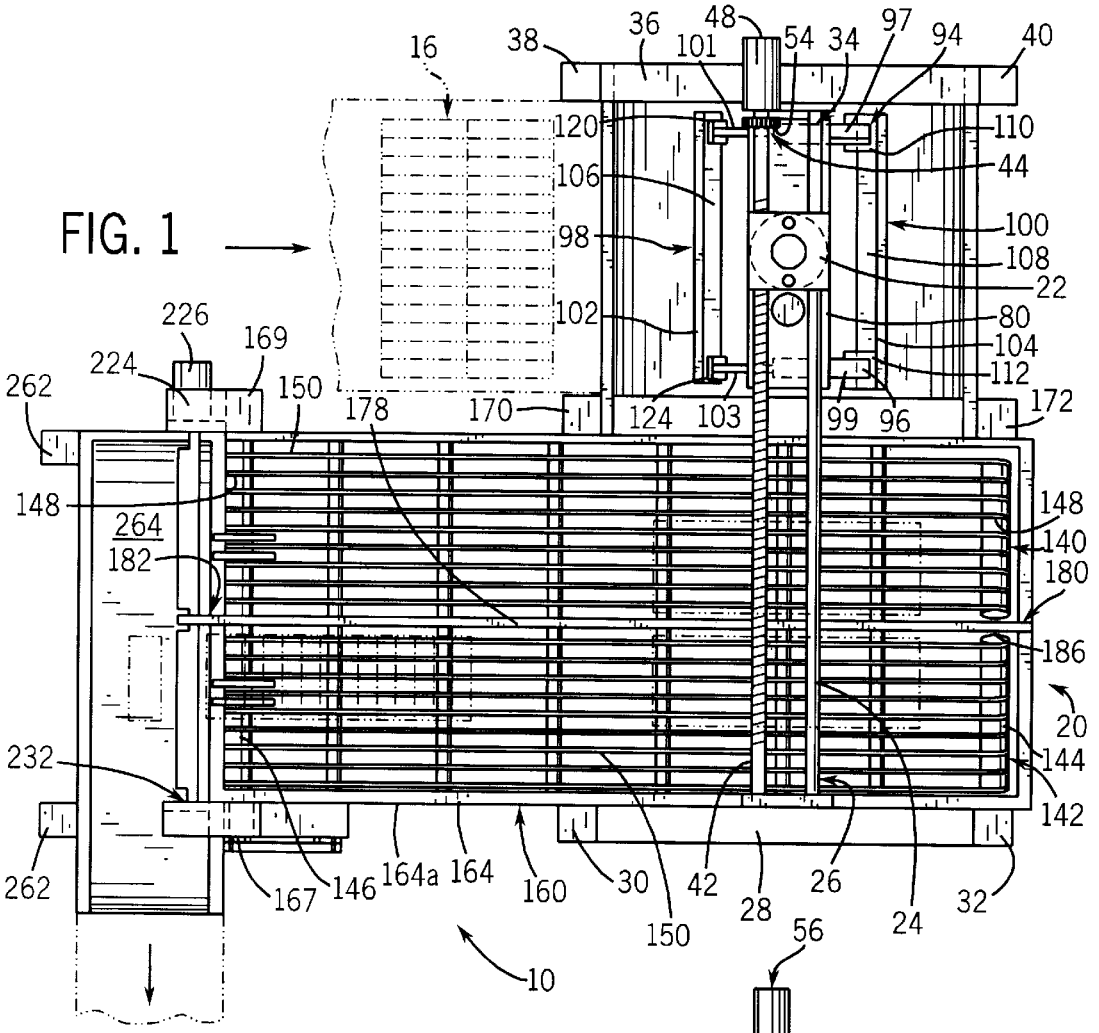
FIG. 1 is a top plan view showing the denesting device of the present invention.
FIG. 2 is a side elevational view, partially in section, showing the denesting device of FIG. 1.
Figure 5:
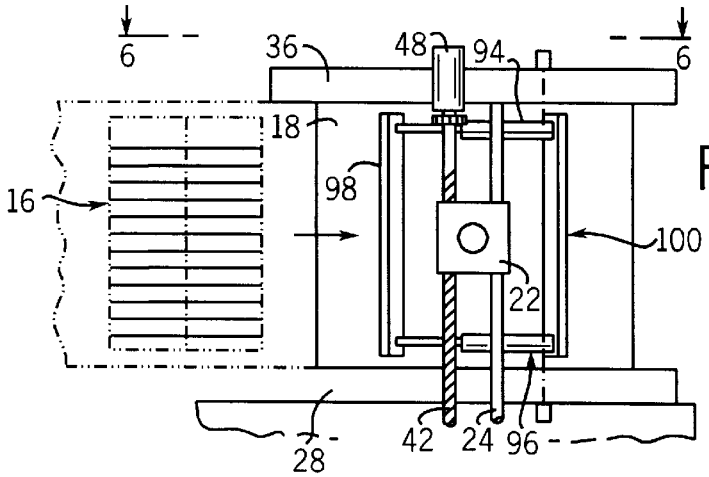
FIG. 5 is a top plan view showing a portion of the transport structure of the denesting device of FIG. 1.

In accordance with the present invention, a denesting device is generally designated by the reference numeral 10. As best seen in the drawings, denesting device 10 may be used in connection with the denesting of precut blocks of cheese into a predetermined number of pieces or subparts. However, it is contemplated as being within the scope of the present invention for denesting device 10 to denest precut blocks constructed from other types of material.

Referring to FIG. 3, denesting device 10 includes a transport structure generally designated by the reference numeral 12 for transporting layers 14*a–c* of a precut block of material 16 from a supply conveyor 18 to a conveyor structure generally designated by the reference numeral 20. Transport structure 12 includes a carriage 22 slidably supported over a support surface. Carriage 22 is slidably mounted on a support rod 24 which extends between cross braces 28 and 36. Support rod 24 has a first end 26 interconnected to cross brace 28 which interconnects legs 30 and 32. A second end 34 of rod 24 is interconnected to a cross brace 36 which is supported by and interconnects legs 38 and 40. As described, cross braces 28 and 36 support rod 24, and hence carriage 22, above supply conveyor 18 and conveyor structure 20.

Carriage 22 is also supported by a lead screw 42 which extends between and is rotatably supported by cross braces 28 and 36. Lead screw 42 is threaded through a passageway in carriage 22 and includes a first end 44 having a gear 46 projected radially therefrom. Gear 46 of lead screw 42 meshes with a drive gear 54 which is mounted on the end of a drive shaft 52 of a motor 48.

Motor 48 is mounted on the upper surface 50 of cross brace 36 and includes drive shaft 52 extending therefrom. Drive gear 54 and gear 46 of lead screw 42 are meshed such that rotation of drive shaft 52 by motor 48 causes rotation of gear 46, and hence of lead screw 42. As is conventional, rotation of lead screw 42 in passageway of carriage 22 causes carriage 22 to travel on lead screw 46 and hence, on support rod 26.

Figure 8:
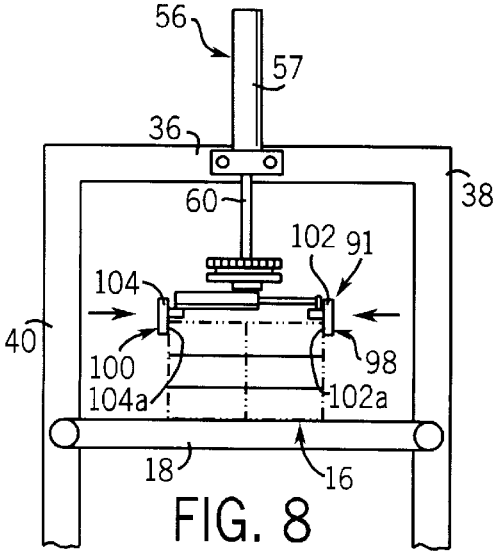
FIG. 8 is a cross-sectional view similar to FIG. 7, showing the gripper element of the transport structure in a closed configuration engaging the outer periphery of the first layer of the block of precut material to be denested.
Figure 17:
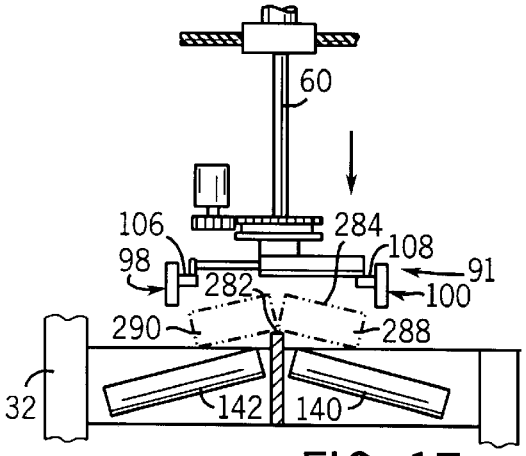
FIG. 17 is a cross sectional view, similar to FIG. 15, showing the gripper element of the transport structure in a fully lowered position breaking the first layer of the block of material into first and second positions.

Transport structure 12 further includes a cylinder 56 having a housing 57 mounted to the upper surface 58 of carriage 22. As best seen in FIG. 8, cylinder 56 further includes a piston 60 which extends through an opening 59 in carriage 22 and which is movable between a first retracted position, FIG. 6, and a fully extended position, FIG. 17. End 62 of piston 60 is mounted to the upper surface 64 of a gripper element support plate 66.

Support plate 66 includes first and second guide rods 67*a* and 67*b,* respectively, which extend vertically from the upper surface thereof through corresponding openings 69*a* and 69*b,* respectively. Guide rods 67*a* and 67*b* guide the movement of piston 60 between the retracted and the fully extended positions. A rotatable bush 70 is seated within an opening 72 in gripper element support plate 66. The underside 76 of bush 70 is mounted to the upper surface 74*a* of a gear 74. Gear 74 meshes with a drive gear 90 which is mounted on the end of a rotatable drive shaft 88 of a motor 86.

Motor 86 is mounted to gripper element support plate 66 and includes rotatable drive shaft 88 extending therefrom. Drive gear 90 and gear 74 are meshed such that rotation of drive shaft 88 by motor 86 causes rotation of gear 74 and hence, bush 70 within opening 72 in gripper element support plate 66.

A gripping element 91 is supported by the underside 74*b* of gear 74. Gripping element 91 includes a cross bar 80 extending between and interconnecting first and second gripping cylinders 94 and 96, respectively. Gripping cylinders 94 and 96 include corresponding housings 97 and 99 and corresponding pistons 101 and 103 therein. As hereinafter described, gripping cylinders 94 and 96 interconnect gripping bars 98 and 100.

Gripping bars 98 and 100 include corresponding vertical gripping walls 102 and 104, respectively, and corresponding horizontal elements 106 and 108, respectively, which are directed toward each other. Gripping bar 100 includes first and second cylinder mounting brackets 110 and 112, respectively, at opposite ends thereof. Similarly, a first piston mounting bracket 120 is mounted to the upper surface of horizontal arm 106 at a first end of gripping bar 98 and a second piston mounting bracket 124 is mounted to the upper surface of horizontal arm 106 at a second, opposite end of gripping bar 98.

Housing 97 of first gripping cylinder 94 has a first end mounted to the upper surface of cylinder mounting bracket 110 on gripping bar 100. Piston 101 of gripping cylinder 94 is mounted to the upper surface of piston mounting bracket 120 on gripping bar 98. Similarly, housing 99 of second gripping cylinder 96 has a first end mounted to the upper surface of cylinder mounting bracket 112 on gripping bar 100, and piston 134 is mounted to the upper surface of piston mounting bracket 124 of gripping bar 98. As described, the axial movement of pistons 101 and 103 into and out of housings 97 and 99, respectively, of cylinders 94 and 96, respectively, controls movement of gripping bar 98 toward and away from gripping bar 100, i.e. between a gripping position and an open position.

Referring to FIG. 1, conveyor structure 20 includes first and second conveyors 140 and 142, respectively. Each conveyor 140 and 142 are identical, and hence, the description hereinafter describing conveyor 140 is understood to describe conveyor 142. Conveyor 140 includes first and second drive rollers 144 and 146 at opposite ends thereof. Each drive roller 144 and 146 rotates counterclockwise to drive belts 150 as hereinafter described. Each drive roller 144 and 146 includes a plurality of belt engaging sheaves 148 extending radially therefrom. Each sheave 148 on drive roller 144 is axially aligned with a corresponding sheave 148 on drive roller 146. Belts 150 are positioned over corresponding sheaves 148 of drive roller 144 and over sheaves 148 of drive roller 146 such that rotation of drive rollers 144 and 146 causes the belts 150 to travel counterclockwise in FIG. 1.

Conveyors 140 and 142 are supported on a conveyor support frame 160. Conveyor support frame 160 includes first and second parallel side frame members 162 and 164 interconnected by first and second end frame members 166 and 168 so as to form the generally rectangular support frame. Side frame member 164 includes an outer surface 164*a* which is interconnected to vertical support legs 30, 32, and 167. The outer surface 162*a* of side frame member 162 is interconnected to vertical support legs 169, 170, and 172.

Figure 20:
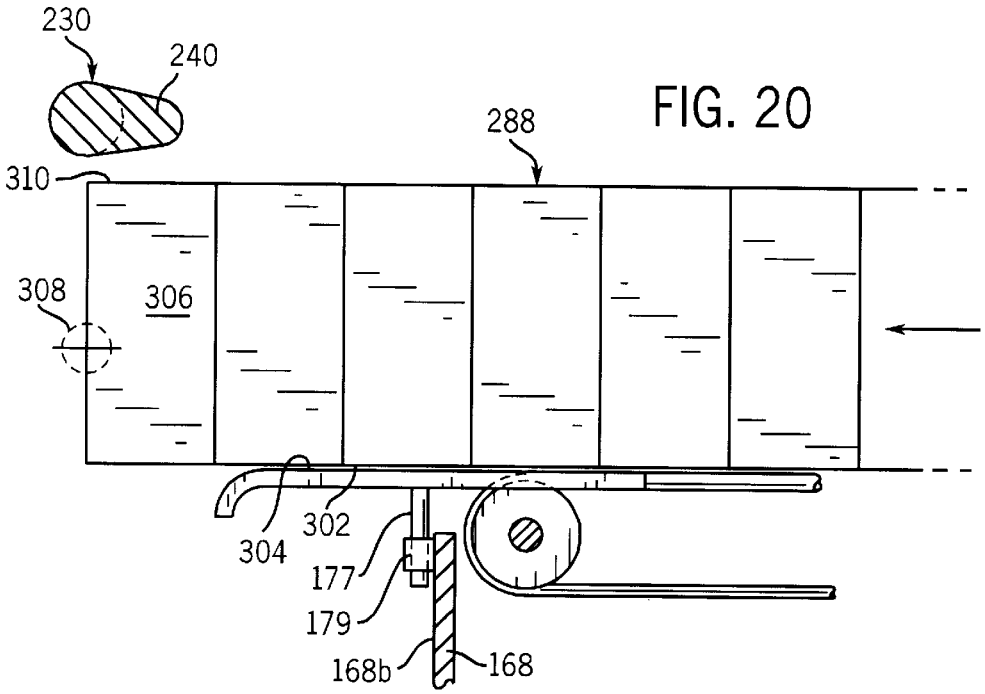
FIG. 20 is an enlarged, cross sectional view showing the denesting of the first layer of the block of material.

First and second pairs of skies 173 and 175, respectively, are interconnected to and extend from second end frame member 168 adjacent conveyors 140 and 142, respectively. As best seen in FIG. 20, each ski includes a support rod 177 depending therefrom. Each support rod 177 is adapted for receipt in a corresponding support rod receipt element 179 extending from the outer surface 168*b* of second frame support member 168.

Support frame 150 further includes an intermediate frame member 178 which has a first end 180 interconnected to end frame member 166 and a second, opposite end 182 interconnected to end frame member 168. Intermediate frame member 178 is positioned between conveyors 140 and 142. Intermediate frame member 178 further includes a raised portion 186 which extends vertically from the upper edge 188 of intermediate frame member 178 and inwardly from end frame member 166. As hereinafter described, raised portion 186 functions as a breaker bar to break a layer of the block of material into two distinct portions. It is contemplated that drive rollers 144 of conveyors 140 and 142 extend downwardly from intermediate frame member 178 so as to facilitate the breaking of the layer of the block of material into the two portions.

Conveyor support frame 160 further includes a plurality of support rods 190 which extend between intermediate frame member 178 and a corresponding side frame member 162 and 164. Support rods 190 prevent belts 150 of each conveyor 140 and 142 from sagging and prevent material transported thereon from falling through the belts 150 of conveyors 140 and 142.

Drive rollers 146 of conveyors 140 and 142 are independently driven by a corresponding motor in an identical manner, and hence, the description of the driving of drive roller 146 of conveyor 142 is understood to describe the rotating of drive roller 146 of conveyor 140. A sheave 200 is mounted to the outer end of drive roller 146. Sheave 200 is interconnected to a motor 202 by a belt 204 which is seated in the groove of sheave 200. Motor 202 is supported by a support member 206 which extends from leg 167. In operation, rotation of the drive shaft of motor 202 drives belt 204 thereby causing rotation of sheave 200. Rotation of sheave 200, in turn, causes rotation of drive roller 146. Rotation of drive roller 146 causes belts 150 to travel as heretofore described.

The denesting device of the present invention further includes a denesting structure generally designated by the reference numeral 220. Denesting structure 220 includes support flanges 222 and 224 extending from corresponding upper end of support legs 167 and 169, respectively. A motor 226 is mounted to the underside 228 of support flange 224. Motor 224 is interconnected to a first end 229 of a denesting shaft 230 which is rotatable about a longitudinal axis. The second end 232 of the denesting shaft 230 is rotatably mounted to the underside of support flange 222 extending from the upper end of support leg 167.

Denesting shaft 230 includes an intermediate portion 234 having a generally circular cross section. Intermediate portion 234 passes through an aperture 236 formed in the second end 182 of intermediate support frame member 178. Denesting shaft 230 further includes a first conveyor denesting portion 240 and a second conveyor denesting portion 242. Denesting portions 240 and 242 of denesting shaft 230 have a generally tear-dropped shaped cross section and are aligned with corresponding conveyors 140 and 142, respectively.

Denesting device 10 further includes a belt conveyor structure which is generally designated by the reference numeral 250. Belt conveyor structure 250 includes a generally rectangular support frame 252 having first and second side frame members 254 and 256 and end frame members 258 and (not shown). The outer surface 260 of side frame member 254 of belt conveyor 250 is interconnected to the outer surface 168*b* of end frame member 168 of conveyor support frame 160. A plurality of legs 262 are interconnected to the outer surface 256*a* of side frame member 256 of belt conveyor support frame 252 in order to support belt conveyor support frame 252 above a supporting surface.

Conveyor belt support frame 252 houses a conveyor 264 which travels longitudinally between side frame members 254 and 256 of belt conveyor support frame 252. As best seen in FIGS. 1–2 and 4, conveyor 264 is positioned below the denesting portions 240 and 242 of denesting shaft 230.

Figure 6:
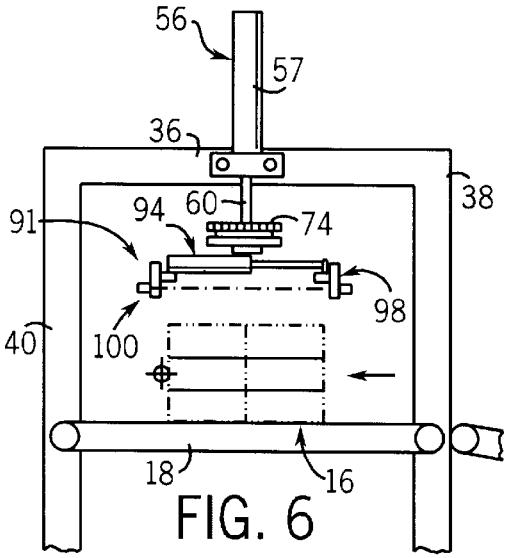
FIG. 6 is a cross-sectional view of FIG. 5 taken along line 6—6 showing the transport structure of the denesting device in a first position.
Figure 7:
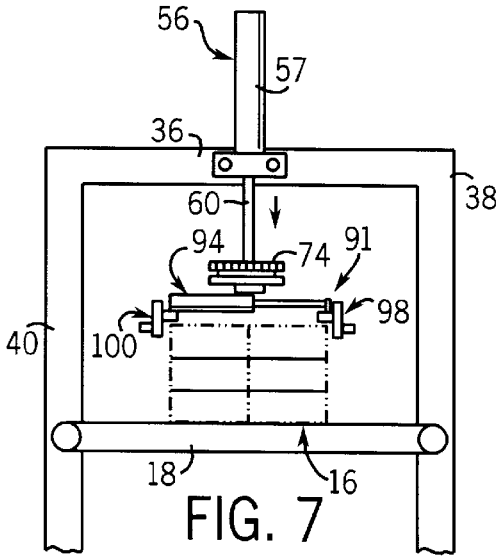
FIG. 7 is a cross-sectional view, similar to FIG. 6, showing the gripper element of the transport structure in an open configuration about the periphery of a first layer of a block of precut material to be denested.
Figure 9:
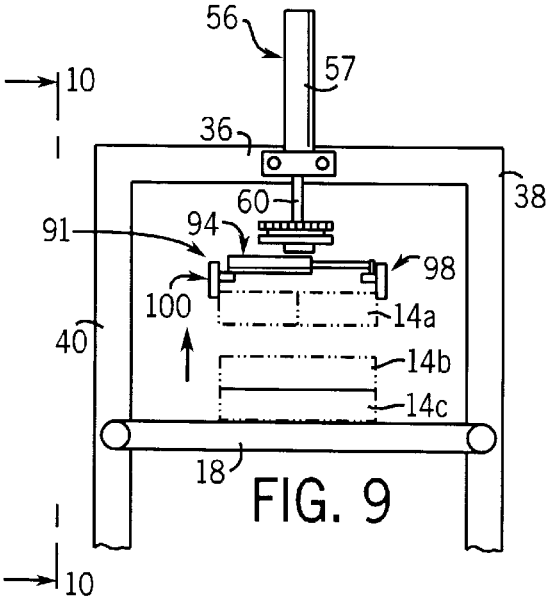
FIG. 9 is a cross sectional view, similar to FIG. 8, showing the gripper element of the transport structure lifting the first layer from the block of precut material.
Figure 10:
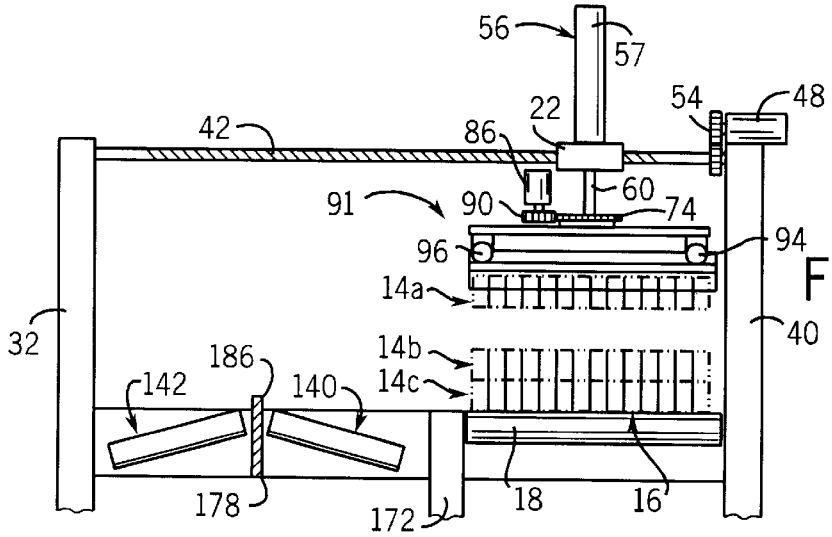
FIG. 10 is a cross sectional view of FIG. 9 taken along line 10—10 showing the gripper element of the transport structure in a raised position.

In operation, conveyor belt 18 transports the block material 16 to a position underneath the gripper element 91, FIG. 6. With gripper element 91 in the open position, cylinder 56 is actuated such that piston 60 is extended from housing 57 to a first layer pickup position, FIG. 7. Gripping cylinders 94 and 96 are retracted such that pistons 101 and 103 are received within housings 97 and 99, respectively, and such that gripper bars 98 and 100 are moved toward each other. The inner surfaces 102*a* and 104*a* of vertical gripping walls 102 and 104, respectively, engage the outer edge of the first layer 14*a* of the block of precut material 16, FIG. 8. Thereafter, piston 60 is retracted within housing 57 of cylinder 56 so as to allow transport the first layer 14*a* of the block of precut material to conveyor structure 20, FIG. 9.

Figure 11:
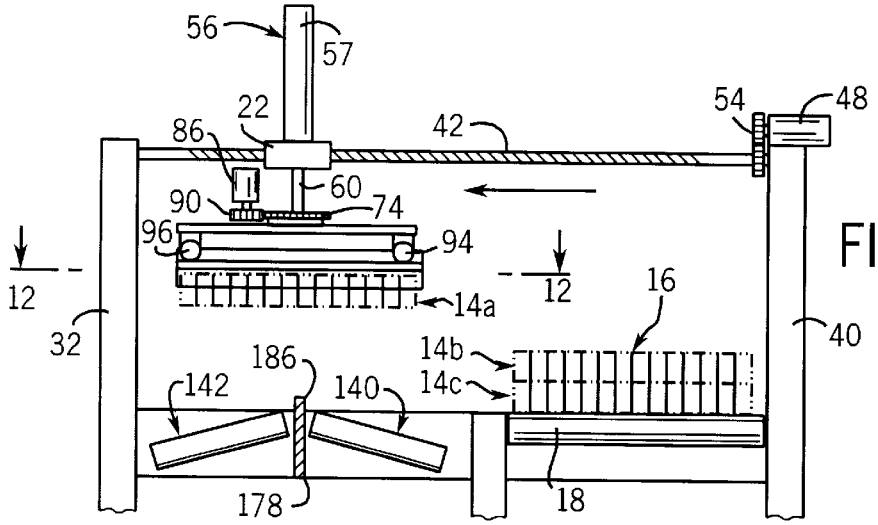
FIG. 11 is a cross sectional view similar to FIG. 10 showing the gripper element transported by the transport structure over the conveyor of the denesting device of the present invention.
Figure 12:
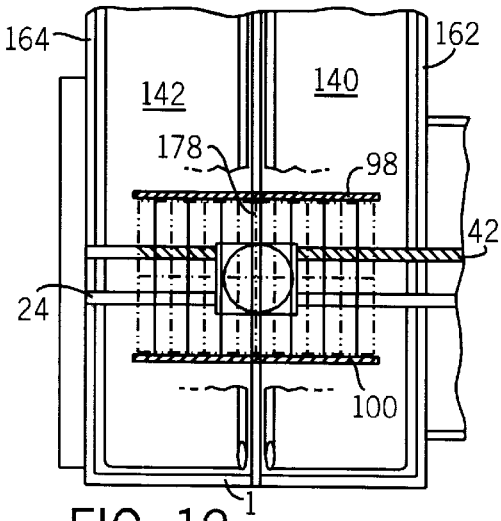
FIG. 12 is a cross sectional view of FIG. 11 taken along line 12—12.
Figure 13:
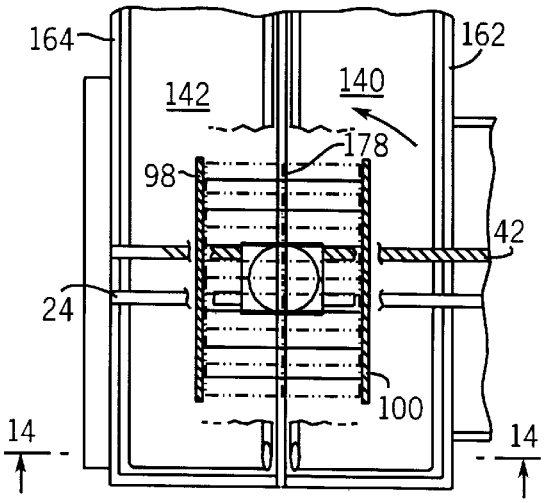
FIG. 13 is a cross sectional view, similar to FIG. 12, showing the gripper element of the transport structure rotated b 90degrees.
Figure 14:
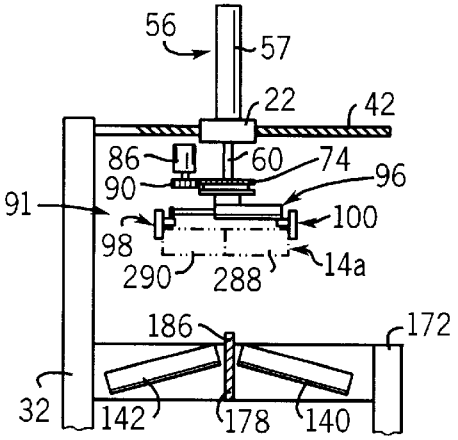
FIG. 14 is a cross sectional view of FIG. 13 taken along line 14—14.

Motor 48 is actuated so as to rotate lead screw 42, as heretofore described. By rotating lead screw in a first direction, carriage 22 slides along support rod 24. Motor 48 continues to rotates lead screw 42 until carriage 22 is centered over the raised portion 186 of intermediate frame member 178, FIGS. 11–12. Motor 86 is actuated so as to rotate drive gear 90 which, it turn, meshes with and rotates gear 74. Gear 74 is rotated until gripper element 91 is rotated ninety degrees such that gripping bars 98 and 100 are parallel to intermediate frame member 178 and side frame members 162 and 164, FIGS. 13–14.

Figure 15:
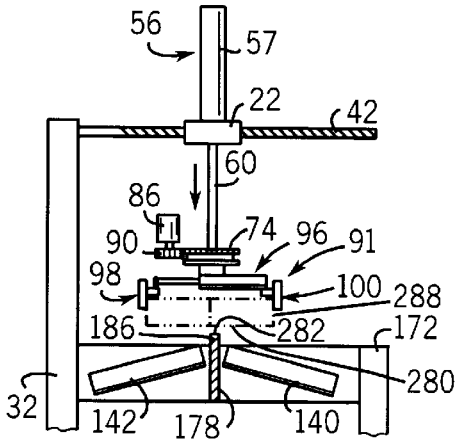
FIG. 15 is a cross sectional view, similar to FIG. 14, showing the gripper element of the transport structure in a lowered position above the conveyor of the denesting device of the present invention.
Figure 16:
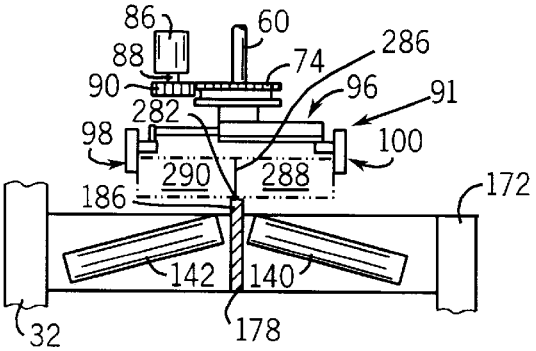
FIG. 16 is a enlarged, cross sectional view, similar to FIG. 15, showing a gripper element of the transport structure in the open configuration and releasing the first layer of the block of material above the conveyor of the denesting device of the present invention.
Figure 18:
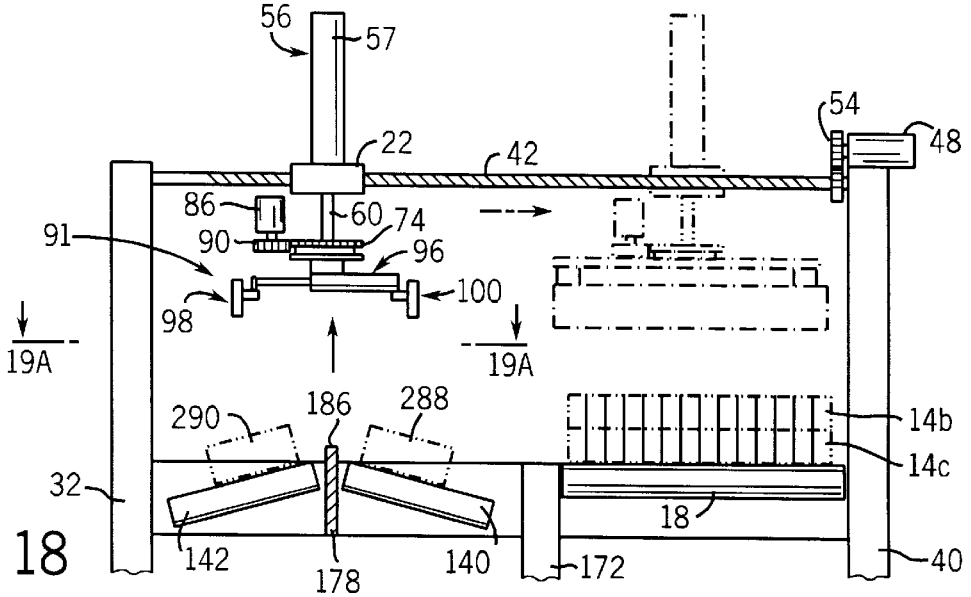
FIG. 18 is a cross sectional view, similar to FIG. 3, showing the gripper element of the transport structure in its raised position.

Piston 60 is extended from housing 57 of cylinder 56 to a first release position such that the underside 280 of first layer 14*a* of the block of precut material 16 engages the upper edge 282 of the extended portion 186 of intermediate frame member 178, FIG. 15. Cylinders 94 and 96 are actuated such that pistons 101 and 103 extend from housings 97 and 99, respectively, and gripper element 91 returns to the open position, FIG. 16. With gripper element 91 in the open position, piston 60 is extended from housing 57 of cylinder 56 to a breaking position such that the horizontal elements 106 and 108 engage the upper surface 284 of the layer of precut material thereby breaking the layer of precut material along cut line 286 and such that a first portion 288 of the layer of precut material is deposited on conveyor 140 and a second portion 290 of the layer of precut material is deposited on conveyor 142, FIG. 18.

After depositing first layer 14*a* of the block of precut material 16 on conveyors 40 and 42, piston 60 is retracted within housing 57 of cylinder 56. Motor 48 is actuated so as to rotate lead screw 42 in a second, opposite direction. By rotating lead screw 42 in the second direction, carriage 22 slides along support rod 24 until carriage 22 is centered over the remaining layers 14*b* and 14*c* of the block of precut material 16.

Figure 19A:
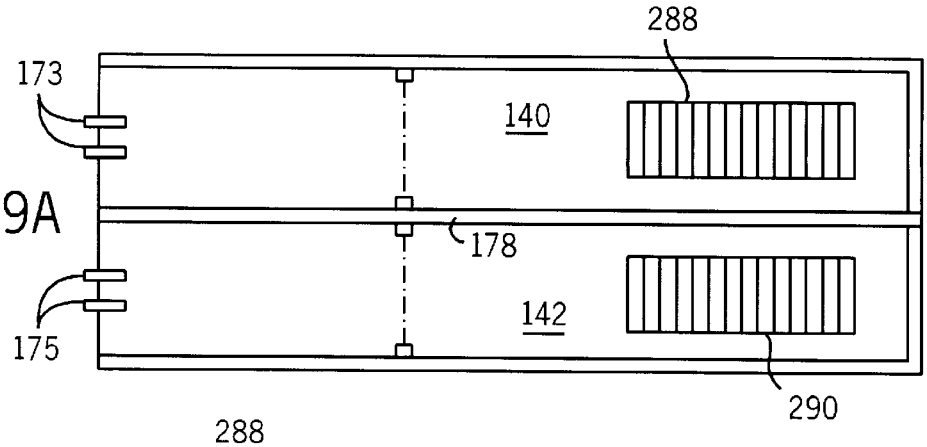
FIG. 19*a* is a cross sectional view of FIG. 18 taken along line 19*a*—19*a;*
Figure 19B:
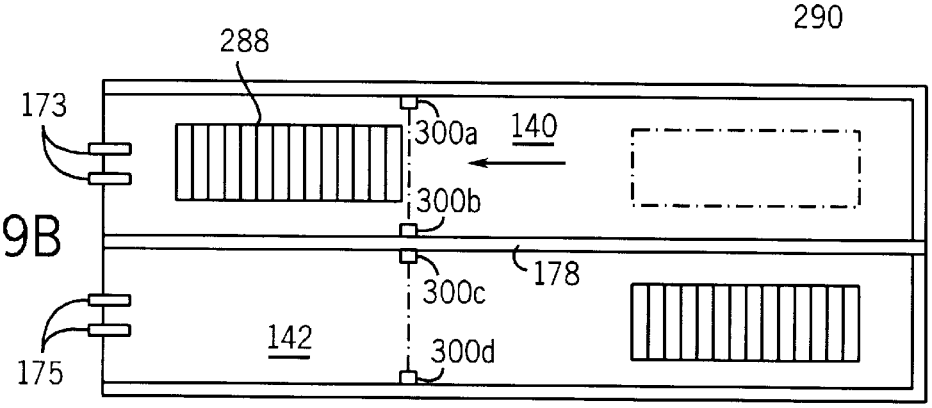
FIGS. 19*b*–19*h* show the steps of conveying and denesting the first layer of the block of material deposited on the conveyor of the denesting device of the present invention.
Figure 19C:
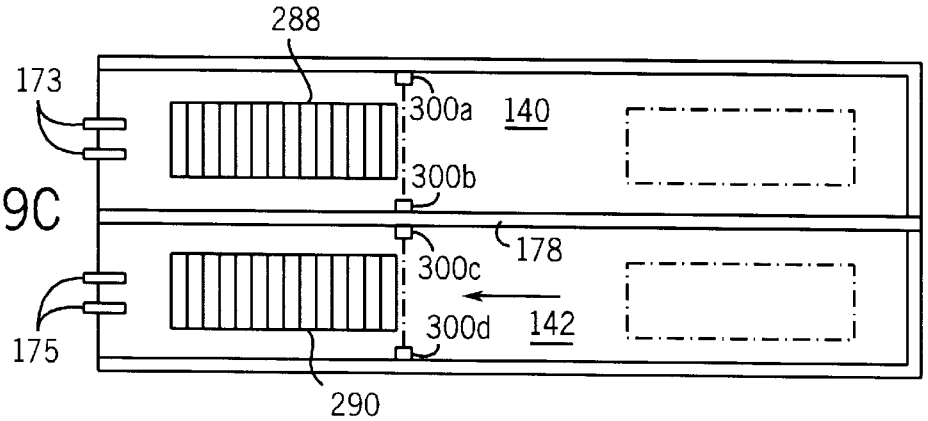

Referring to FIG. 19*a,* a motor (not shown) is actuated so as to rotate drive roller 146 of conveyor 140 causing belts 150 to travel. As belts 150 travel, portion 288 is transported from right to left, FIG. 19*b,* toward denesting structure 220. At a location determined by sensors 300*a* and 300*b,* conveyor 140 is stopped, FIG. 19*b.* Thereafter, motor 202 is activated thereby driving drive roller 146 of conveyor 142 and causing belts 150 of conveyor 142 to travel from right to left in FIGS. 1–2. This, in turn, causes portion 290 to travel toward denesting structure 220 to a position determined by sensors 300*c* and 300*d,* FIG. 19*c.*

Figure 19D:
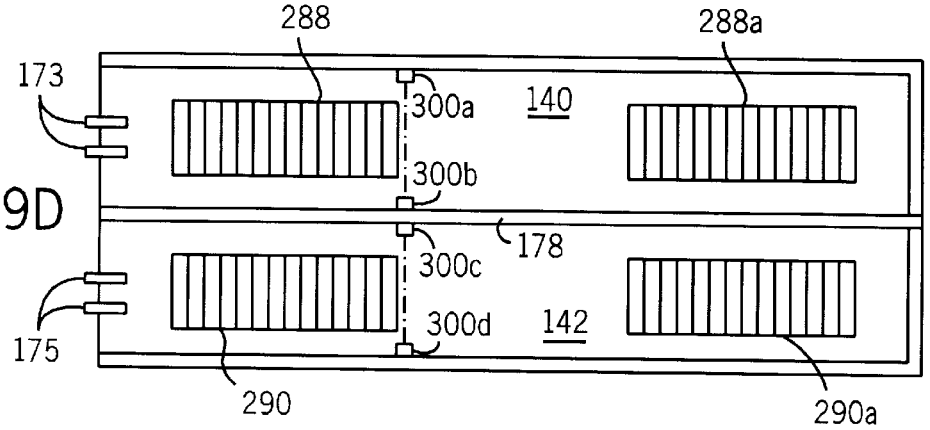

Thereafter, the second layer 14*b* of the block of precut material 16 is deposited on conveyors 140 and 142 in the manner same as described with respect to the first layer 14*a.* As best seen in FIG. 19*d,* portions 288*a* and 290*a* comprise the second layer 14*b* of the block of precut material 16.

Figure 19E:
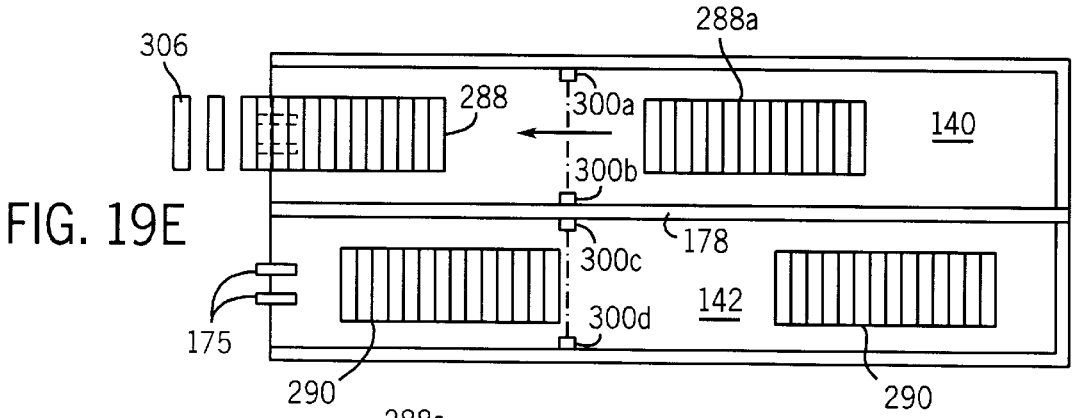
Figure 19F:
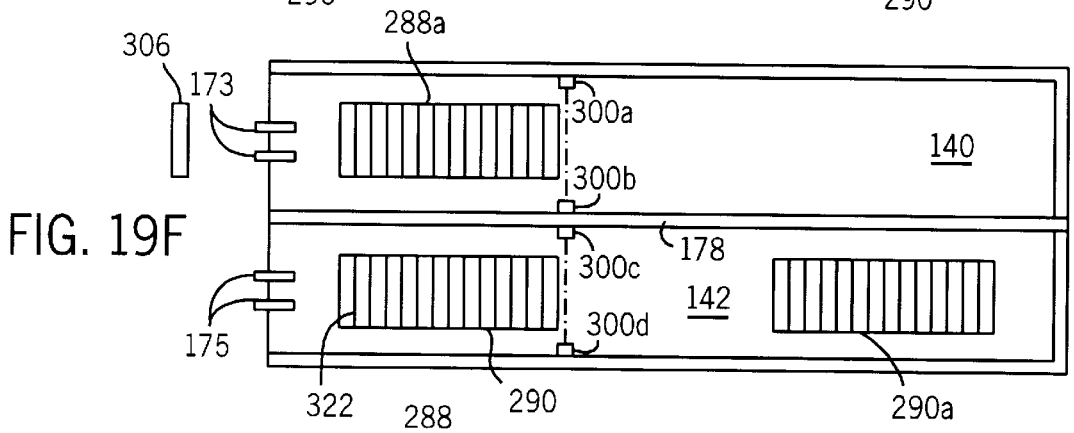
Figure 21:
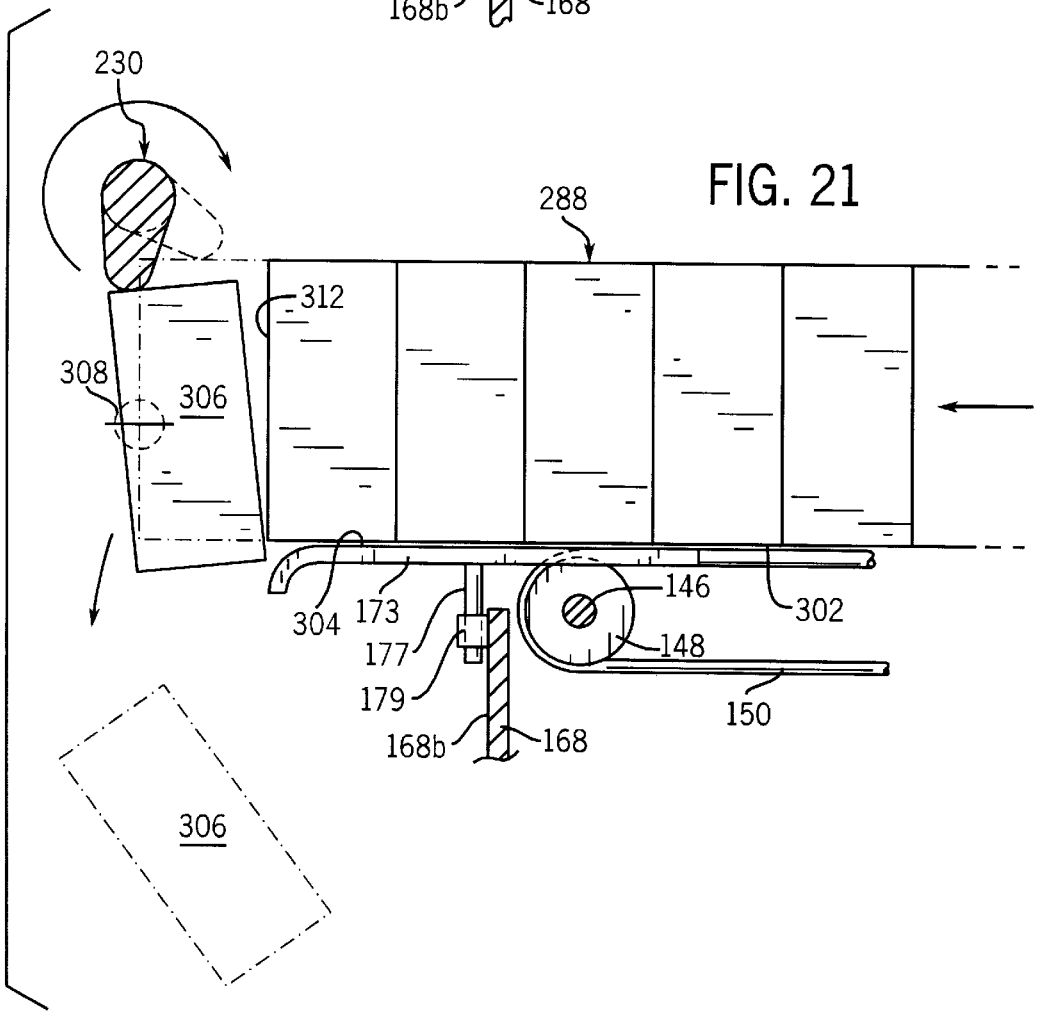
FIG. 21 is a cross sectional view, similar to FIG. 20, showing a subpart of the block of material after denesting.

Referring to FIG. 19*e,* conveyor 140 is actuated so as to convey portions 288 and 288*a* thereon from right to left in FIG. 19*e.* As conveyor 140 travels from right to left in FIG. 19*e,* portion 288 of first layer 14*a* of the block of precut material 16 is urged onto pair of skies 173 such that the underside 302 of portion 288 forms a slidable interface with the upper surface 304 of skis 173. As best seen in FIGS. 20–21, when a piece 306 of the portion 288 is urged off of skis 173, piece 306 triggers a sensor 308 which actuates motor 226 of denesting structure 220. Motor 226 rotates denesting shaft 230 clockwise such that the first denesting portion 240 of denesting shaft 230 engages the upper surface 310 of piece 306. By engaging the upper surface 310 of piece 306, first denesting portion 240 of denesting shaft 230 causes piece 306 to separate from portion 288 of the first layer 14*a* of the block of precut material 16 along cut line 312. This, in turn, causes piece 306 to fall downwardly, shown in phantom in FIG. 21, onto conveyor belt 264. The process is continued until the first portion 288*a* of the second layer 14*b* of the block of precut material 16 has passed sensors 300*a* and 300*b,* FIG. 19*e.*

Figure 19G:
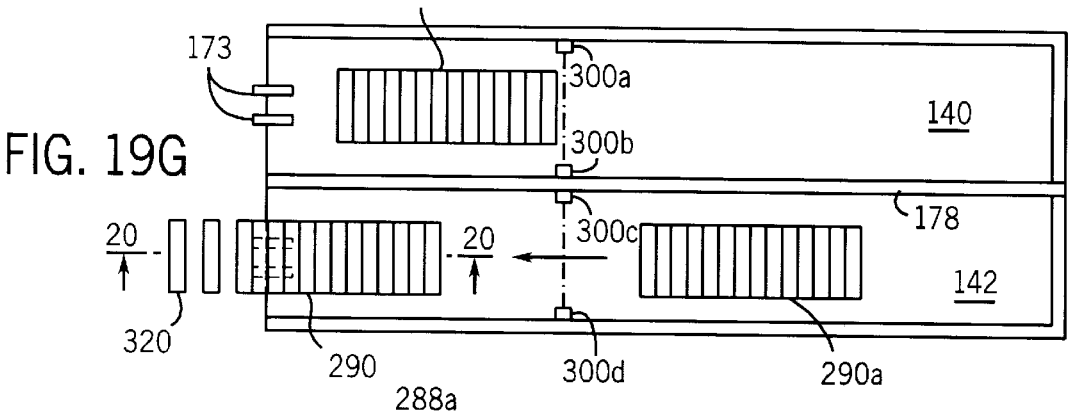
Figure 19H:
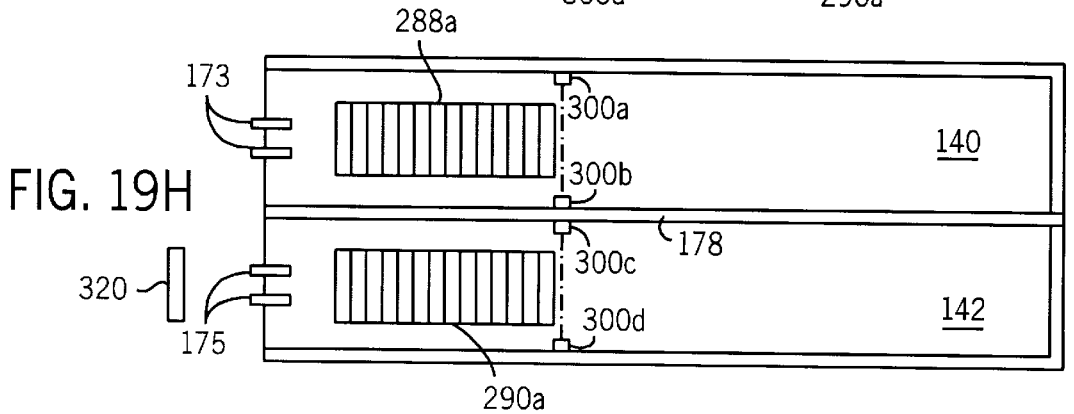

Thereafter, conveyor 142 is actuated such that portions 290 and 290*a* on belts 150 of conveyor 142 travel from right to left in FIG. 19*g.* As conveyor 142 travels from right to left in FIG. 19*g,* portion 290 of first layer 14*a* of the block of precut material 16 is urged onto a pair of skies 175 such that the underside portion 290 forms a slidable interface with the upper surface of skies 175. When a piece 320 of a portion 290 is urged off of skies 175, piece 320 triggers a sensor 308 which actuates motor 226 of denesting structure 220. Motor 226 rotates a denesting shaft 230 clockwise such that second denesting portion 242 of denesting shaft 230 engages the upper surface of piece 320. By engaging the upper surface of piece 320, second denesting portion 242 of denesting shaft 230 causes piece 320 to separate from portion 290 of the first layer 14*a* of the block of precut material 16 along cut line 322. The process is continued until the first portion 290*a* of the second layer 14*b* of the block of precut material 16 has pass sensors 300*c* and 300*c,* FIG. 19*h.* Thereafter, the third layer 14*c* of the block of precut material 16 is then transported onto conveyors 140 and 142 as heretofore described with respect to first layer 14*a.* The steps described in FIGS. 19*d–h* are repeated in order to denest portions 288*a* and 290*a* of second layer 14*b* of the block of precut material 16.

It is further contemplated that an additional block of precut material may be positioned by a supply conveyor 18 after the first block of precut material has been removed therefrom.

Figure 22:
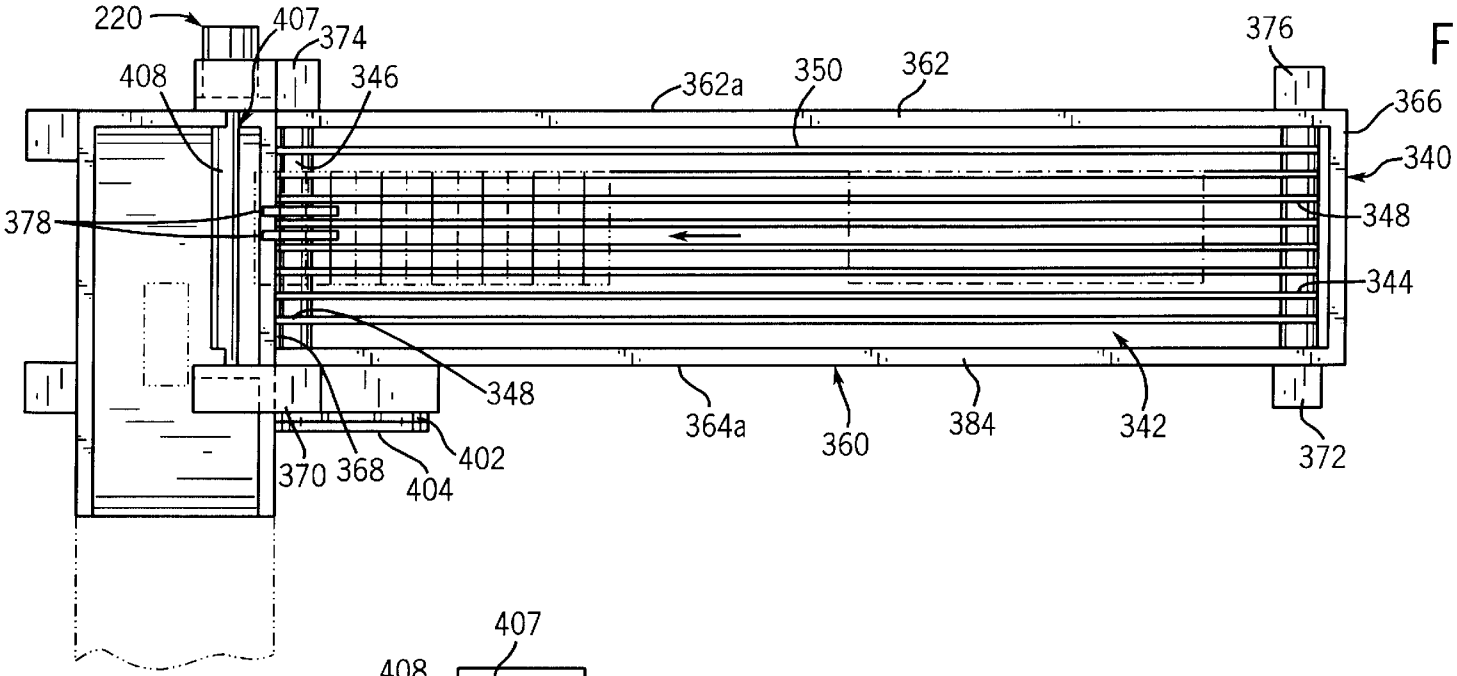
FIG. 22 is a top plan view showing an alternate embodiment of the conveyor for use in the denesting device of the present invention.
Figure 23:
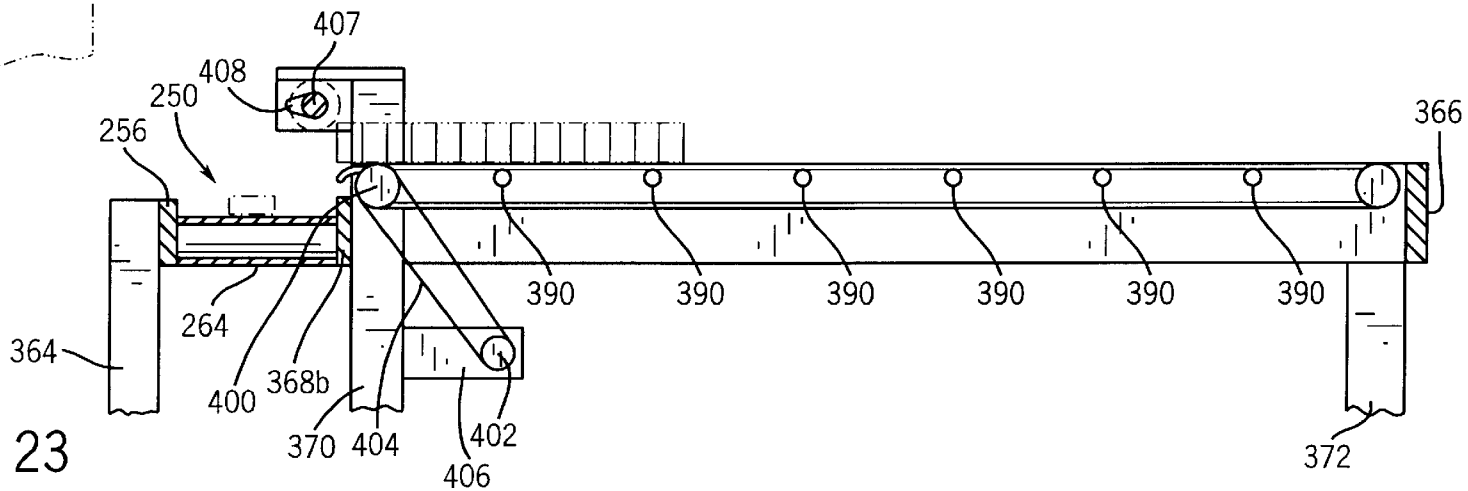
FIG. 23 is a side elevational view, partially in section, showing the conveyor of FIG. 22.

Referring to FIGS. 22–23, an alternate conveyor structure 340 is shown. Conveyor structure 340 includes a single conveyor 342 having first and second drive rollers 344 and 346 at opposite ends thereof. Each drive roller rotates counterclockwise so as to drive conveyor 342 from right to left in FIGS. 22–23. Each drive roller 344 and 346 includes a plurality of belt engaging sheaves 348 extending radially therefrom. Each sheave 348 on roller 344 is axially aligned with a corresponding sheave 348 on drive roller 346. Belts 350 are positioned over corresponding sheaves 348 of drive roller 344 and over sheaves 348 of drive roller 346 such that rotation of drive rollers 344 and 346 causes the belts 350 to travel counterclockwise in FIGS. 22 and 23.

Conveyor 340 is supported on a conveyor support frame 360. Conveyor support frame 360 includes first and second parallel side frame members 362 and 364 interconnected by first and second end frame members 366 and 368 so as to form the generally rectangular support frame. Side frame member 364 includes an outer surface 364*a* which is interconnected to vertical support legs 370 and 372. The outer surface 362*a* of side frame member 362 is interconnected to vertical support legs 374 and 376. Skies 378 extend laterally from end frame member 368.

Conveyor support frame 360 further includes a plurality of support rods 390 which extend between side frame members 362 and 364. Support rods 390 prevent belts 350 of conveyors 340 from sagging and prevent material transported thereon from falling through the belts of conveyor 340. Drive roller 346 is driven by a motor 402. A sheave 400 is mounted to the outer end of the drive roller 346. Sheave 400 is interconnected to motor 402 by a belt 404 which is seated in the groove of sheave 400. Motor 402 is supported by a support member 406 which extends from leg 370. In operation, rotation of the drive shaft of motor 402 drives belt 404 thereby causing rotation of sheave 400, and hence, rotation of drive roller 346. Rotation of drive roller 346, in turn, causes belts 350 to travel as heretofore described.

The denesting device shown in FIGS. 22 and 23 is identical to denesting device 220 but for denesting shaft 407 which has a single denesting portion 408. Denesting portion 408 has a generally tear-dropped shaped cross section and is aligned with conveyor 340. Conveyor belt structure 250, as heretofore described, is mounted below denesting structure 220 on the outer surface 368*b* of end frame member 368.

Various alternatives and embodiments are contemplated as being within the scope of the following claims particularly pointing out and distinctly claiming the subject matter regarded as the invention.

I claim:

1. A denesting device for denesting a precut block of material into a plurality of individual sub-parts, comprising:

a conveyor structure having first and second opposite ends;

a belt structure traveling on the conveyor structure for conveying the block of material from the first to the second end of the conveyor structure;

a denesting structure positioned adjacent the second end of the conveyor, the denesting structure including:

a rotatable shaft extending transverse to the belt structure and having a teardrop shaped cross-section, wherein as the rotatable shaft makes one rotation, only an outermost denesting portion of the teardrop shaped shaft engages the block of material as the block of material extends over the second end of the conveyor structure and denests an individual sub-part from the block of material such that the individual sub-parts falls from the second end of the conveyor structure; and a sub-part conveyor vertically spaced from the second end of the conveyor structure, the sub-part conveyor receiving thereon each individual sub-part denested from the block of material by the denesting structure and transporting each individual sub-part to a user defined location.

2. The denesting device of claim 1 wherein the belt structure includes first and second belts travelling on the conveyor structure, each belt extending along a corresponding axis.

3. The denesting device of claim 2 further comprising a breaker bar positioned between the first and second belts of the belt structure, the breaker bar separating the block of material into first and second block portions upon the placement of the block of material on the second end of the conveyor structure.

4. The denesting device of claim 3 wherein the breaker bar extends along an axis parallel to the axis of the each belt.

5. The denesting device of claim 1 further comprising:

a transport structure for transporting the precut block of material and placing the same onto the first end of the conveyor.

6. The denesting device of claim 5 wherein the transport structure includes a gripping element for gripping the block of material, the gripping element movable between a first open position and a second gripping position.

7. The denesting device of claim 6 wherein the gripping element includes first and second parallel gripping arms interconnected by a retractable cylinder.

8. The denesting device of claim 7 wherein each of the gripping arms includes a first vertical arm to prevent lateral movement of the block of material when the block of material is being transported by the transport structure.

9. The denesting device of claim 6 wherein the transport structure includes a carriage movable between a first pick-up location and second depositing location overlapping the second end of the conveyor structure.

10. The denesting structure of claim 9 further comprising gripper positioning structure interconnecting the carriage and the gripping element, the gripper positioning structure movable between a first lowered position and a second depositing position.

11. The denesting device of claim 10 wherein the gripper positioning structure is movable between the second depositing position and a third breaking position.

12. The denesting device of claim 11 wherein the carriage is supported by a lead screw and a support rod, wherein rotation of the lead screw transports the carriage along the support rod between the pick-up and the deposit locations.

13. The denesting device of claim 12 further comprising a ramp structure having a first end mounted to the second end of the conveyor structure and a second, opposite end.

14. The denesting device of claim 6 wherein each gripping arm includes a horizontal material engaging arm for abutting the block of material during transport of the same by the transport structure.

15. The denesting device of claim 1 wherein the second end of the ramp structure curves downwardly toward the subpart conveyor.

16. The denesting device of claim 1 further comprising a sensor, the sensor sensing when a portion of the block of material extends over the second end of the conveyer structure and causing rotation of the rotatable shaft in response thereto.

17. A denesting device for denesting a block of precut material, comprising:

a conveyor having first and second opposite ends and a belt structure traveling therebetween, the belt structure conveying the block of material from the first end of the conveyor over the second end of the conveyor; and a denesting structure positioned adjacent the second end of the conveyor, the denesting structure including a rotatable shaft extending transverse to the belt structure and having a generally teardrop shaped cross-section wherein as the rotatable shaft makes one rotation, only an outermost denesting portion of the teardrop shaped shaft engages a portion of the block of material as the block of material is urged over the second end of the conveyor by the belt structure and denests an individual sub-part from the block of material such that the individual sub-part falls from the second end of the conveyor.

18. The denesting device of claim 17 further comprising a ramp structure having a first end mounted to the second end of the conveyor and a second, opposite end.

19. The denesting device of claim 18 further comprising a sub-part conveyor vertically spaced from the second end of the conveyor for receiving from the individual sub-part from the second end of the conveyor.

20. The denesting device of claim 19 wherein the second end of the ramp structure curves downwardly toward the sub-part conveyor.

21. The denesting device of claim 17 wherein the belt structure includes first and second belts travelling on the conveyor, each belt travelling along a corresponding axis.

22. The denesting device of claim 21 further comprising a breaker bar positioned between the first and second belts of the belt structure, the breaker bar separating the block of material into first and second block sections upon the placement of the block of material on the first end of the conveyor wherein each section of the block of material is received on a corresponding belt of the belt structure.

23. The denesting device of claim 22 wherein the breaker bar extends along an axis parallel to the axis of each belt.

24. The denesting device of claim 17 further comprising a transport structure for transporting the block of material and placing the same onto the first end of the conveyor.

25. The denesting device of claim 24 wherein the transport structure includes a gripping element for gripping the block of material, the gripping element movable between a first open position and a second gripping position.

26. The denesting device of claim 25 wherein the gripping element includes first and second parallel gripping arms interconnected by a retractable cylinder.

27. The denesting device of claim 26 wherein each of the each of the gripping arms includes a first vertical arm to prevent lateral movement of the block of material when the block of material is being transported by the transport structure.

28. The denesting device of claim 27 wherein each gripping arm includes a horizontal material engaging arm for abutting the block of material during transport of the same by the transport structure.

29. The denesting device of claim 25 wherein the transport structure includes a carriage movable between a first pick-up location and second depositing location overlapping the second end of the conveyor.

30. The denesting device of claim 29 further comprising gripper positioning structure interconnecting the carriage and the gripping element, the gripper positioning structure movable between a first lowered position and a second transport position.

31. The denesting device of claim 17 wherein the carriage is supported by a lead screw and a support rod, wherein rotation of the lead screw transports the carriage along the support rod between the pick-up and the deposit locations.

32. The denesting device of claim 30 wherein the gripper positioning structure is movable between the second transport position and a third breaking position.

33. The denesting device of claim 17 further comprising a sensor, the sensor sensing when a portion of the block of material is urged over the second end of the conveyer and causing rotation of the rotatable shaft in response thereto.

* * * * *